United States Patent [19]

Green

[11] Patent Number: 4,665,596

[45] Date of Patent: May 19, 1987

[54] FASTENING DEVICE

[76] Inventor: Neville K. Green, 2601 Queenswood Drive, Victoria, B.C. V8N 1X6, Canada

[21] Appl. No.: 801,622

[22] Filed: Nov. 25, 1985

[30] Foreign Application Priority Data

Dec. 11, 1984 [CA] Canada ..... 469768

[51] Int. Cl.[4] ..... B65D 43/10

[52] U.S. Cl. ..... 24/662; 24/664; 220/283; 292/DIG. 38

[58] Field of Search ..... 24/664, 662, 170, 191, 24/20 EE; 292/DIG. 38, DIG. 49; 220/315, 272, 283

[56] References Cited

U.S. PATENT DOCUMENTS

| | | | |
|---|---|---|---|
| 571,794 | 11/1896 | Record | 220/315 |
| 573,829 | 12/1896 | Mixer et al. | 24/662 |
| 739,673 | 9/1903 | Harris | 24/662 |
| 911,137 | 2/1909 | Lange | 220/283 |
| 1,433,197 | 10/1922 | Gardner | 24/662 |
| 3,466,076 | 9/1969 | Bisbing | 292/DIG. 38 |
| 3,490,805 | 1/1970 | DiPierro et al. | 292/DIG. 38 |
| 3,817,419 | 6/1974 | Moller et al. | 220/315 |
| 4,216,984 | 8/1980 | Hofmann et al. | 292/DIG. 38 |
| 4,358,032 | 11/1982 | Libit | 220/283 |
| 4,425,689 | 1/1984 | Fildan | 24/664 |

FOREIGN PATENT DOCUMENTS

| | | |
|---|---|---|
| 1029727 | 5/1966 | United Kingdom . |
| 1136095 | 12/1968 | United Kingdom . |

*Primary Examiner*—Victor N. Sakran

[57] ABSTRACT

A fastening device for the connection of any two members that would normally move apart under use. The fastening device consists of two components, one providing a tongue and the other a fulcrum against which the tongue bears in the fastened condition of the device. The arrangement of the components ensures that in passing between the unfastened and fastened conditions, the tongue is put into compression, the compressive stress in which acquires a value in a center-point position which is greater than that subsisting in the fastened condition of the device. Thus fastening and unfastening of the device involves moving the tongue through this center-point position.

12 Claims, 15 Drawing Figures

FASTENING DEVICE

TECHNICAL FIELD

This invention relates to a two-component releasable fastening device of simple design which can be used inter alia as a buckle, for securing together the ends of a strap member (e.g. an automobile roof rack or sports-related activity harness), as a catch for closing a lid on a container or a sash window in its frame and as a joining piece for linking otherwise disconnected parts together (e.g. for erecting furniture from a supplied kit of parts, or closing a hatch on a boat or kayak).

BACKGROUND OF THE INVENTION

The invention is concerned with a two-component releasable fastening device which employs a compressed member in the direct link effecting a connection between the two components.

The advantages of using a compressed member in this way, instead of a tensile member with hook-type attachment as in the heretofore typical knee-lever lock devices, is that it requires only one hinge or none at all. This makes the device more suitable for production using an injection-moulding technique, whereas a typical knee-lever lock requires two hinges or more, or else requires a self-hinging system to be employed if it is to be injection-moulded. See, for example, U.S. Pat. No. 3,466,076 (Bisbing).

Furthermore, the invention, because it does not rely on a self-hinge system for its operation, may be injection-moulded in many different kinds of plastics material—such as nylon, a material known under the Trade Mark "Delrin", or polypropylene—without compromising the effectiveness of the fastening device.

DISCUSSION OF PRIOR ART

With regard to the prior art, there have been many variations to the basic knee-lever lock which typically uses a hook and catch system. When leverage is applied the hook is put under tensile stress, and equilibrium is achieved when the lever passes a dead centre-point. The variations to this basic concept are all concerned with the use of different materials, e.g. U.S. Pat. No. 3,466,076 (Bisbing)—which typically requires the use of polypropylene—or with the method of attachment, e.g. U.S. Pat. No. 3,490,805 (Di Pierro), U.S. Pat. No. 4,213,643 (Blind) and U.S. Pat. No. 4,035,009 (Jacobs). All these prior proposals use the typical clasp and pull-to-lock principle.

SUMMARY OF THE INVENTION

In its broadest aspect, the invention relates to a two-component releasable fastening device, the first component of which provides a fulcrum against which the free end of a compressive stress-absorbing tongue of the second component bears during a fastening operation and in the fastened condition of the device. The device is characterised in that, in passing between the unfastened and fastened conditions, the compressive stress in the tongue acquires a value in a centre-point position which is greater than that subsisting in the tongue in the fastened condition of the device.

The two components of the fastening device may be conveniently formed, using the injection-moulding process, from a variety of plastics materials. Materials other than plastics may be found appropriate in certain applications of the invention. In the event that the fastener is made of polypropylene, it may be found convenient to incorporate a self-hinging section. However, in other materials this is not necessary to the effective operation of the fastener.

The essential novelty in the fastener device depends on the use of a central tongue or a bifurcated tongue to hold together the two members that are required to be attached. As the component to which the tongue is attached is rotated into the equilibrium position, the tip of the tongue pivots about the single or multiple choice fulcrum, and may not then be rotated in a reverse direction, i.e. in order to free the tongue from its temporary attachment to the fulcrum, without the tongue passing through the center-point position. This additional effort required to overcome the compressive stress stored primarily in the deformation of the tongue and/or in the resilience of the method of joining the two components, prevents unwitting release of the tongue.

BRIEF DESCRIPTION OF THE DRAWINGS

The invention will now be further described, by way of example, with reference to the accompanying drawings, in which.

DESCRIPTION OF THE PREFERRED EMBODIMENTS

Figure 1:
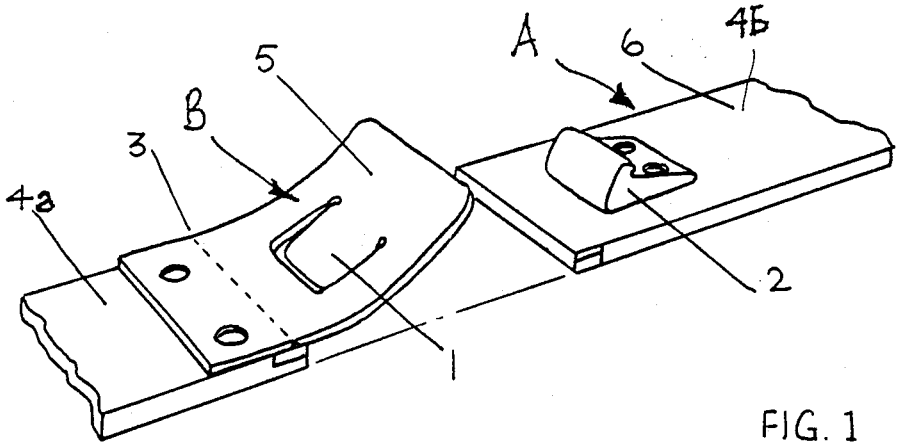
FIG. 1 is a perspective view of one form of fastening device before the two component parts are drawn together.
Figure 2:
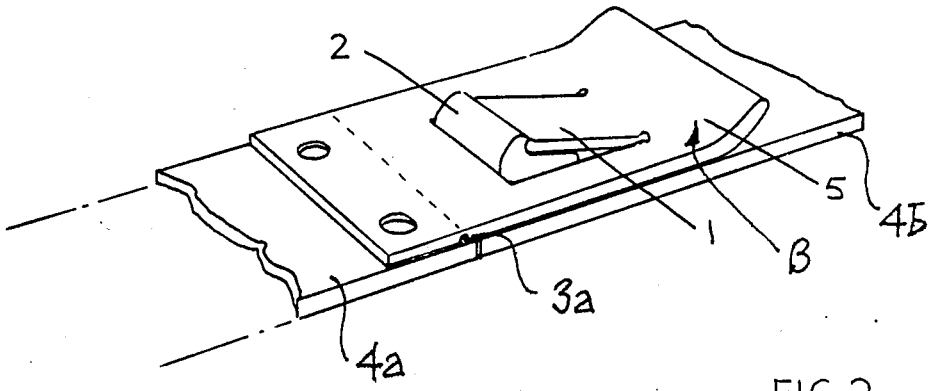
FIG. 2 is a perspective view of the device of FIG. 1 after the two component parts are locked together.

FIGS. 1 and 2 show a fastening device having two components A and B used to fasten together two members 4*a* and 4*b*. Component B has a central tongue 1 which derives its flexibility either from being made from a flexible material (e.g. a plastics material) or by means of a hinge mechanism located at an axis 3. As component B is drawn over component A containing a fulcrum 2, the flexibility inherent in the point of attachment of the tongue 1 at the axis 3 to the member 4*a*, allows a finger grip 5 to be lifted and guided so that the tongue 1 locates in the fulcrum 2. The finger grip is then pressed down, bringing part 5 into the dead centre-point position in line with the tongue 1 at which the compressive stress in the tongue 1 acquires a maximum value. Further pressuretakes the tongue 1 through this position to a point of equilibrium resting against the base 6 of the first component A to which the fulcrum 2 is attached. The fastener is now in the locked position and may only be released by sufficient pressure being exerted in a reverse direction on the finger grip 5 to bring the tongue 1 again through the dead centre-point, at which time the compressive stress held in the tongue 1 is released by means of further movement in the same direction.

The axis 3 can be created by thinning the flexible material of component B (e.g. by means of a groove shown at 3*a* in FIG. 2).

Figure 3:
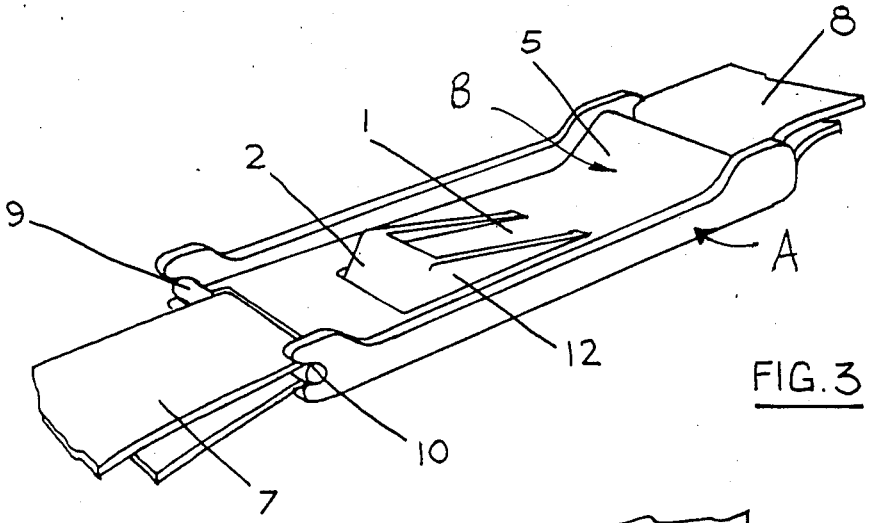
FIG. 3 is a perspective view of a second form of fastening device as used in a specific application, e.g. a quick release buckle for a safety harness.

FIG. 3 is a perspective view showing one of many possible specific applications. In this embodiment the stress built up in the tongue 1 during closure, is partially transmitted to strap attachments 7 and 8 as in the tightening of the straps attached to a roof rack for an automobile, for example.

Figure 4:
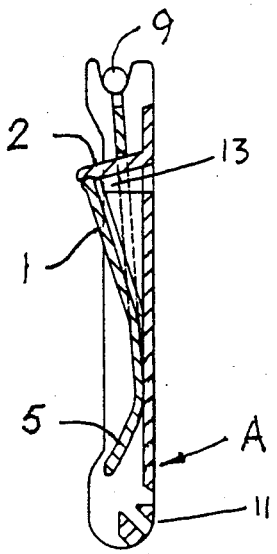
FIG. 4 is a side sectional elevation of the device of FIG. 3.
Figure 5:
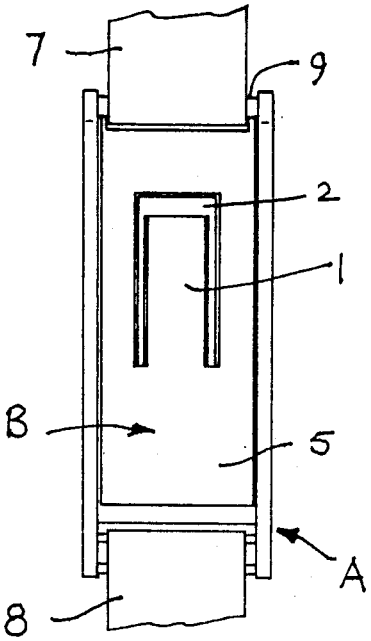
FIG. 5 is a plan view of the device shown in FIG. 3.

In the specific case, the tongue 1 and the finger grip 5 are integrally attached to component B which is provided with cylindrical ends 9 which pivot about a point 10. Component B also carries connected to it, the strap 7. On the component of the fastener, an integrally moulded pair of supports 11 allows the strap 8 on this side to be adjustable to the length required. Also in this example, side walls 12 are used to increase rigidity in the fulcrum and to improve appearance. These side walls may carry a narrow buttress 13 to guide the tongue into its correct position on the fulcrum, see FIG. 4 and FIG. 5.

Figure 6:
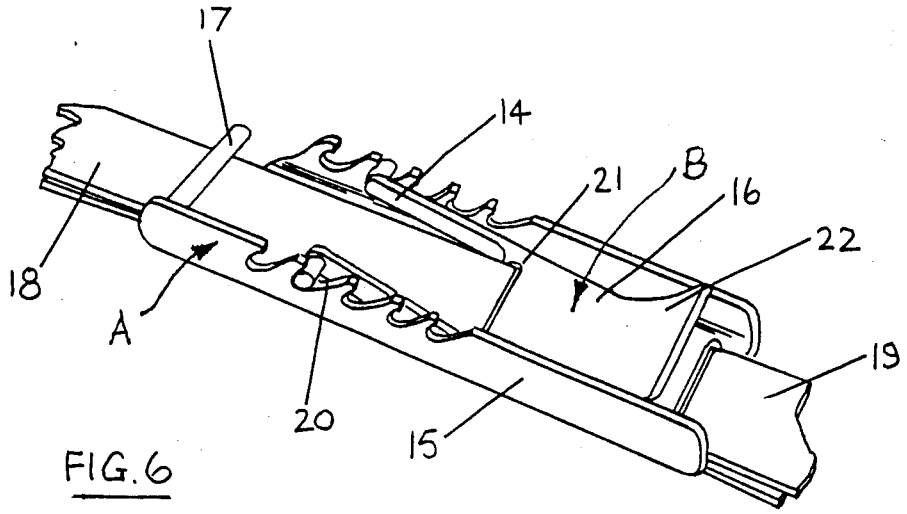
FIG. 6 is a perspective view of a third embodiment of fastening device showing a bifurcated tongue in a multiple-choice fulcrum.

FIG. 6 is a perspective view of another embodiment using a bifurcated tongue 14 in place of the previous central tongue 1. This specific case is useful in those applications requiring more adjustment in the taking up of slack in the straps that are to be attached thereto than is possible in the previous example.

In FIG. 6 the two components A and B of the fastening device are shown together in the locked position. The two components of the fastener are initially brought together. A cylindrical member 17, which is used to maintain correct alignment of an attached strap 18, is moulded integrally with the side of the component A. The strap 18 is looped under this cantilevered member 17 and the cylindrical extremities of the bifurcated tongue 14 are located in an appropriate fulcrum position 20. The strap 18 is attached to component B through a slot 21 which tightens as the finger grip 22 is depressed. A second strap 19, or another end of the strap 18, is attached through an adjustable self-gripping system similar to that shown at 11 in FIG. 4.

Figure 7:
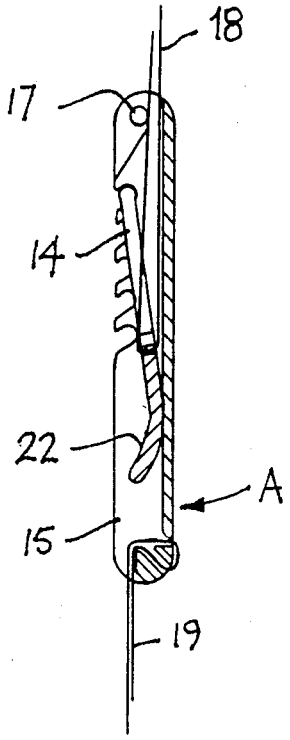
FIGS. 7 and 8 are, respectively, a side sectional elevation and a plan view of the device of FIG. 6.
Figure 8:
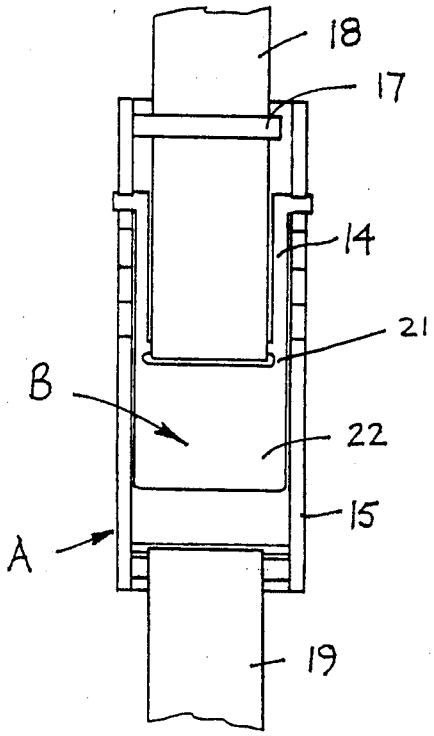

The material used for the two components of the device of FIGS. 6 to 8 may be a plastics material or some other generally non-flexible material such as a die-cast alloy, since inherent flexibility is not required in either of components A or B for this device to function successfully.

Figure 9:
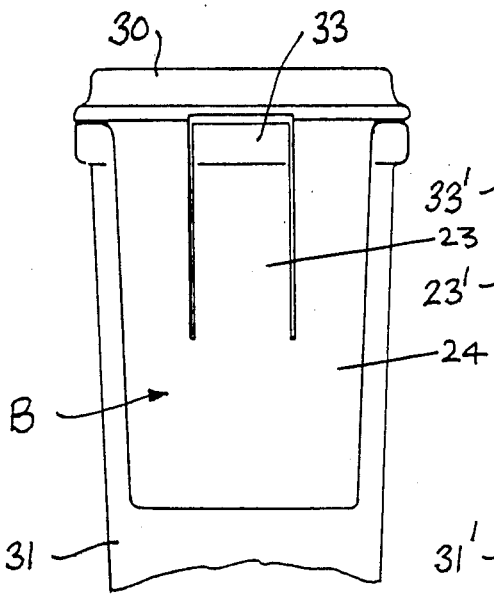
FIG. 9 is a front elevation of a fourth embodiment of fastening device as used to lock down a lid.
Figure 12:
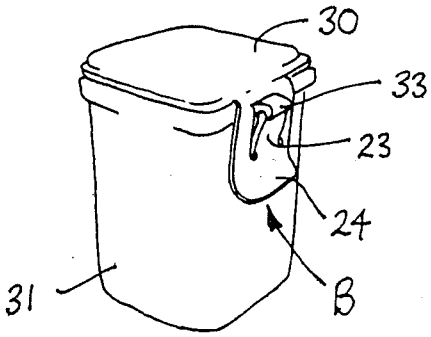
FIG. 12 is a perspective view of the application shown in FIG. 9.

FIGS. 9 and 12 show a front elevation and perspective view, respectively, of a fastening device as applied to a hinged lid 30 on a container 31. A tongue 23 is attached to a finger grip 24 which in turn is hinged, either by a self-hinging system (as when the material is injection-moulded in polypropylene) to the lid 30 or is hinged by a more traditional hinge mechanism (not shown).

The finger grip 24 and tongue 23 form component B of the fastening device and a fulcrum 33 integrally formed on the container 31 forms the first component A.

Figure 10:
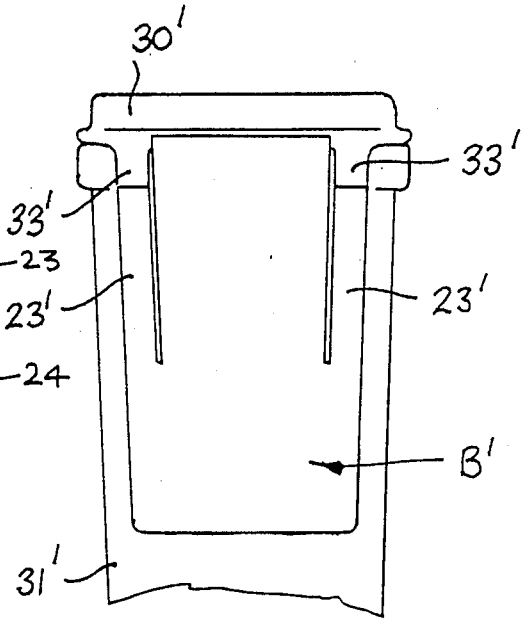
FIG. 10 is a front elevation of a fifth embodiment of fastening device having a bifurcated tongue and used in the same application as FIG. 9.
Figure 11:
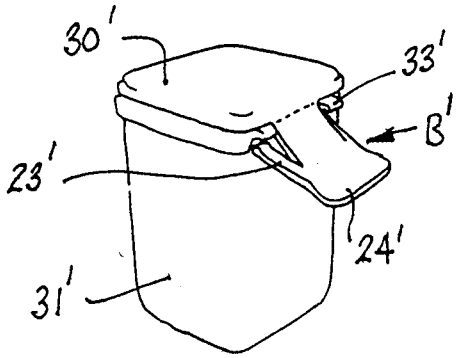
FIG. 11 is a perspective view of the application shown in FIG. 10.

FIGS. 10 and 11 show a modified fastening device for a container with a lid, and in view of its being similar to the embodiment shown in FIGS. 9 and 12, the same reference numerals have been used in both cases with a prime added to the FIGS. 10 and 11 embodiment. It will be noted there are two fulcrums 33' and a bifurcated tongue 23'.

Figure 13:
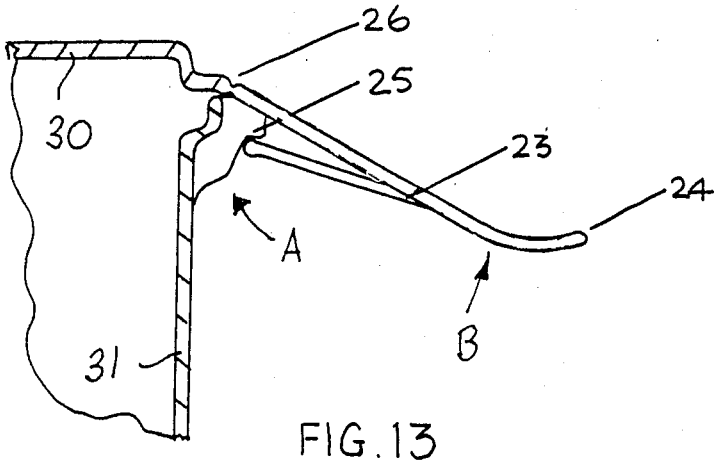
FIG. 13 is a side view of the device of FIG. 9 just as it is beginning to engage.
Figure 14:
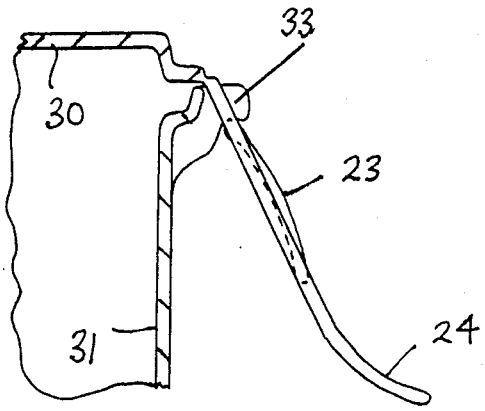
FIG. 14 shows the tongue of FIG. 13 flexing at dead centre-point.
Figure 15:
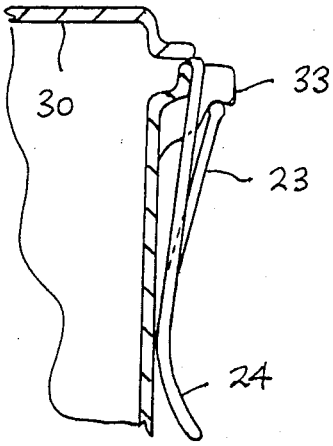
FIG. 15 shows a side view of the device of FIG. 9 in equilibrium in its fully fastened condition.

FIG. 13 shows a side elevation of the fastening device of FIGS. 9 and 12 at the start of a lid locking operation. The tongue 23 is engaged at a pivot point 25 on the fulcrum 33. The finger grip 24 is depressed, thereby bringing the part 24 in line with the tongue 23. In FIG. 14 the tongue is seen at the position of dead centre and is in the condition of maximum stress. The tongue is designed to flex to absorb this stress. Also stress may be absorbed through a sealing ring attached to the lid of the container and through deformation of the fulcrum 33. After the position of dead centre-point is reached, slight relaxation takes place in the tongue 23 and/or the sealing ring and/or the fulcrum 33. In FIG. 15, the finger grip 24 finds a position of equilibrium resting against the side of the container, and may not be released without an up-lifting pressure on the finger grip 24 in a reverse direction.

It will be appreciated that many modifications may be made to the fastening devices shown in the drawings and the invention extends to all such modifications falling within the scope of the following claims.

What is claimed is:

1. A fastening device for releasably securing together two articles comprising a first component secured or securable to one of said articles and including fulcrum means and a second elongate component secured or securable at a first end to the other of said articles and having a second end free to rotate about an axis of rotation, said second component comprising flexible tongue means extending in the elongate direction of said second component, the end of said tongue means remote from said first end of said second component being secured to the second component and the other end of said tongue means being free from said second component and deflectable toward and away from the remainder of the second component, the free end of said tongue means being received by said fulcrum means in the fastened condition of the device and being rotatable against said fulcrum means when the fastening device is released from its fastened condition, wherein the direction of deflection of said free end of said tongue means during release of the device from its fastened condition is contrary to the direction of rotation of said second component about said axis of rotation, and the minimum distance between said free end of said tongue means and said axis of rotation of the second component in the unfastened condition of the device is less than the distance between said fulcrum means and said axis of rotation of said second component in the fastened condition of the device, whereby, in moving said second component to bring the device from its fastened condition to its unfastened condition, said tongue means is subjected to an increase in compressive stress and flexes in order to release said free end of said tongue means from said fulcrum means.

2. A fastening device as claimed in claim 1, in which said tongue means defines a U-shaped aperture in said second component, and said tongue means is deflectable about a further axis located substantially at the location of the end of the tongue means which is attached to the remainder of said second component.

3. A fastening device as claimed in claim 2, in which said fulcrum means is provided adjacent the free end of a projection on said first component, which free end passes through said U-shaped aperture in said second component in the fastened condition of the device.

4. A fastening device as claimed in claim 1, in which said tongue means comprises a pair of flexible tongues located at opposite sides of said second component, each of said tongues being deflectable about a further axis located substantially at the location of the ends of the tongues which are attached to the remainder of said second component.

5. A fastening device as claimed in claim 4, in which said fulcrum means comprises a separate fulcrum on said first component for each of said tongues.

6. A fastening device as claimed in claim 5, in which the first component provides a pair of aligned spaced-apart fulcrums, the second component being bifurcated to provide a respective tongue for each fulcrum.

7. A fastening device as claimed in claim 1, in which said two articles are strap members to which said first and second components are secured.

8. A fastening device as claimed in claim 1, in which two articles are formed by opposite ends of a strap member to the respective ends of which said first and second components are secured.

9. A fastening device as claimed in claim 1, in which said one article is the body of a container provided with a hinged lid, said first component being secured to said body, and in which said other article is said hinged lid and said second component is in the form of a tab attached to said lid.

10. A fastening device as claimed in claim 9, in which the tab is integrally formed with the lid and is turnably attached thereto via a line of weakness defining a hinge.

11. A fastening device as claimed in claim 7, in which the strap member/component securement allows for adjustment of the length of strap member between the free end thereof and the strap member/component securement point.

12. A fastening device as claimed in claim 8, in which the strap member/component securement allows for adjustment of the length of strap member between the free end thereof and the strap member/component securement point.

* * * * *